US005139187A

United States Patent [19]

Fowler

[11] Patent Number: 5,139,187

[45] Date of Patent: Aug. 18, 1992

[54] COMBINATION HANDWARMER, FANNY PACK AND SKI CARRIER

[76] Inventor: David W. Fowler, P.O. Box 773043, Steamboat Springs, Colo. 80477

[21] Appl. No.: 736,349

[22] Filed: Jul. 26, 1991

[51] Int. Cl.[5] ..... A45C 15/00

[52] U.S. Cl. ..... 224/151; 224/917; 224/205; 224/224; 2/66; 2/162; D2/611

[58] Field of Search ..... 224/151, 202, 205, 224, 224/228, 255, 257, 258, 917; 2/66 , 162, 270; 219/211; D2/611, 612, 614; 126/204; 294/147, 148; 150/154, 162; 206/315.1

[56] References Cited

U.S. PATENT DOCUMENTS

| | | | |
|---|---|---|---|
| D. 6,826 | 8/1873 | Gross et al. | D2/612 |
| D. 115,369 | 5/1939 | Block | D2/612 |
| 25,582 | 10/1859 | Phillips | 2/66 |
| 55,260 | 6/1866 | Eckert | 2/66 |
| 176,644 | 4/1876 | Kaehler | 2/66 |
| 228,790 | 6/1880 | Tower | 2/270 |
| 297,526 | 4/1884 | Lorsch | 2/270 |
| 422,272 | 2/1890 | Whitney | 2/162 X |
| 467,974 | 2/1892 | Healey | 2/162 X |
| 1,745,590 | 2/1930 | Stanger | 224/205 X |
| 2,160,229 | 5/1939 | Rupert | 2/66 X |
| 2,727,241 | 11/1953 | Smith | 2/66 |
| 3,491,373 | 1/1970 | Thomas | 2/66 |
| 3,793,643 | 2/1974 | Kinoshita | 2/66 |
| 4,107,509 | 8/1978 | Sher et al. | 219/211 |
| 4,408,355 | 10/1983 | Brock | 2/66 |
| 4,495,659 | 1/1985 | Madnick et al. | 2/66 |
| 4,518,107 | 5/1985 | Amos | 224/901 X |
| 4,746,159 | 5/1988 | Webb et al. | 224/917 X |
| 4,792,073 | 12/1988 | Jacober | 224/251 X |
| 4,858,361 | 8/1989 | White | 150/154 X |
| 4,862,519 | 9/1989 | Bull | 2/66 |
| 4,893,357 | 1/1990 | Evans | 2/208 |
| 4,949,887 | 8/1990 | Holmes | 224/151 |
| 4,982,883 | 1/1991 | Ullal et al. | 224/224 X |

FOREIGN PATENT DOCUMENTS

| | | | |
|---|---|---|---|
| 120642 | 7/1930 | Austria | 150/154 |

*Primary Examiner*—Henry J. Recla
*Assistant Examiner*—Glenn T. Barrett
*Attorney, Agent, or Firm*—Earl C. Hancock; Francis A. Sirr

[57] ABSTRACT

A body garment is disclosed having utility as a handwarmer, fanny pack or carrier of elongated articles such as skis. The garment includes a centrally located, tubular, synthetic fleece member of relatively long axial length having a handwarmer chamber with a synthetic moisture wicking cloth lining. A first zipper in the top of the tubular member provides access to the handwarmer chamber and to an open-mesh heat source bag that is located within the handwarmer chamber. A pair fleece cuffs are stitched with on each open end of the tubular member. A pair of cords are attached to each cuff to compliantly control the size of the cuff open ends. An adjustable length belt is attached to the top of the tubular member. A manually releasable coupler enables the belt for encirclement of an individual's waist, for positioning to the front or to the rear, or for shoulder support by the individual.

12 Claims, 2 Drawing Sheets

COMBINATION HANDWARMER, FANNY PACK AND SKI CARRIER

DESCRIPTION

1. Field of the Invention

This invention relates to the field of apparel, and more specifically to the field of muff type body garments having multiple utility.

2. Background of the Invention

The art has generally provided muff type body garments having multiple utility. For example, U.S. Pat. No. 4,862,519 discloses an article that functions as a seat cushion, as a fanny pack, and as a handwarmer muff. The article of this patent is supported at the waist of a user, to the front or to the rear of the user. Another example of general interest is shown in U.S. Pat. No. 4,949,887 wherein utility as a cushion, food holder, and hand or foot warmer is disclosed.

Waist supported handwarmers that contain a heat source are generally old in the art. U.S. Pat. Nos. 2,727,241 and 4,408,355 are examples. The latter patent also shows the use of Velcro to facilitate adjustment of the hand receiving openings.

The provision of a muff having a security pocket therein or thereon is shown in the art. U.S. Pat. Nos. 25,582, 176,644, and 4,893,357, and United States Design Patent U.S. Pat. No. 6,826 are examples.

A shoulder supported muff is shown for example in United States Design Patent U.S. Pat. No. 115,369, and U.S. Pat. No. 3,793,643 shows a strap supported bag having a handwarmer chamber associated therewith.

U.S. Pat. No. 4,495,659 is of general interest for its showing of a muff having overlapping hand pockets that surround a heat source.

While the prior art provides a degree of alternate utility, the need remains in the art for an improved muff type body garment having selectable alternate utility.

SUMMARY OF THE INVENTION

This invention relates to a muff type body garment having multiple utility. More specifically, the body garment of the invention may be used as a handwarmer when positioned to the front of the user, as a fanny pack when positioned to the rear of the user, or as a carrier of elongated articles such as skies, for example cross country skis or telemark skis, when the muff type body garment is carried at the side or back of the user as it is shoulder supported by the user.

The main central portion of a device in accordance with the invention comprises a tubular cloth member that is formed of heat insulating material. This tubular member defines an internal handwarmer chamber that is located between the two open ends of the tubular member. In accordance with the invention, a moisture wicking cloth lines this handwarmer chamber. An open-mesh cloth bag or pocket is located within the handwarmer chamber, so as to hold a heat source within the handwarmer chamber. A zipper is located on or near the top surface of the tubular member, to provide manual access to the handwarmer chamber and to the open top of the open-mesh bag. Positioning of the user's hands within the handwarmer chamber, in contact with the open-mesh bag and its heat source, is provided by way of a pair of tubular cuffs that are stitched one cuff to each open end of the tubular member. These cuffs can be closed, to the extent desired by the user, by the use of an elastic cord that encircles the open end of each cuff. A lock member or barrel shaped locking device is movably mounted on each cord. The position of a lock member on its cord operates to compliantly control the physical size of the generally circular open end of the cuff. An adjustable length belt is attached to the top surface of the tubular member. A manually releasable coupling is provided within the adjustable length of the belt, thereby enabling the belt for alternate encirclement of the waist of an individual, for positioning of the body garment to the front or to the rear of the individual, or the belt may be extended for shoulder support of the body garment by the individual.

When elongated articles are to be shoulder carried by use of the body garment, for example when skis are to be shoulder carried, the skis are inserted through the hand warming chamber, and the lock members are adjusted so that the cords and the cuff openings tightly encircle the binding portion of the skis, i.e. they encircle the balancing portion of an elongated article.

As a feature of the invention, D-ring attachment means is mounted on the front surface of the tubular member, thereby facilitating attachment of ski gloves and the like.

As an additional feature of the invention a zipper-accessable security chamber is stitched to the front surface of the tubular member.

As an additional feature of the invention, the tubular member and the security chamber are formed of a synthetic fleece material, the moisture wicking lining is formed of a synthetic moisture wicking material, the open-mesh cloth bag is formed of a synthetic material, and the cuffs are formed of a synthetic, stretchable, fleece material.

For ease of operation in cold weather, the zippers of the invention include manual pull tabs.

These and other objects and advantages of the invention will be apparent from the following detailed description, which description makes reference to the drawing.

DETAILED DESCRIPTION OF THE INVENTION

The body garment of this invention provides alternate utility as a handwarmer, as a fanny pack, and as a carrier of elongated articles, for example cross country skis, telemark skies, a folding tripod, a folding easel, etc.

When used as a handwarmer, an open-mesh pocket, which is accessible by the use of a zipper opening at the top of the garment, allows placement of a heat source within the handwarmer chamber. A second zipper along the front side of the garment allows access to an article carrying security pocket.

The end openings of the garment are compliantly adjustable in size by the use of two encircling cords whose free ends each mount a slideable barrel shaped locking device. In this way, the end openings can be adjusted to the wrist size of the user, or the end openings can be completely closed when the handwarmer chamber is to be used to carry articles such as gloves, goggles, hats, keys, camera, etc., in the fanny pack utility of the garment, or the end openings can be drawn tightly down to grasp the balancing point of skis that are inserted through the handwarmer chamber.

An adjustable length belt allows the garment to encircle the waist of a user, as a handwarmer or as a fanny pack, or the belt can be extended to enable the garment to be shoulder supported by the user.

Use of heat sources such as chemically activated heat sources, hot water heat sources, and microwave activated heat sources are contemplated by the invention.

Figure 1:
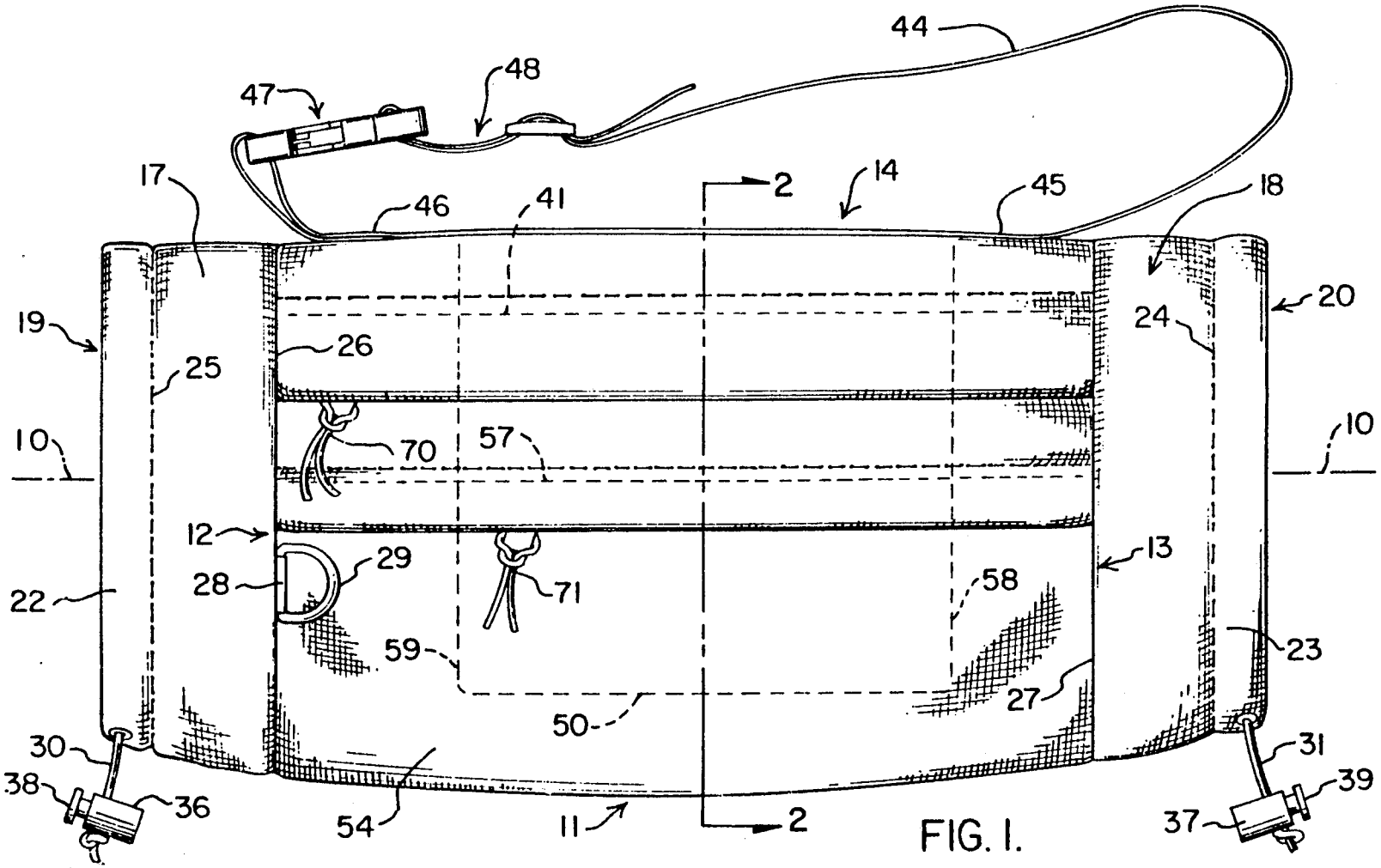
FIG. 1 is a front view of the invention, showing the body garment in its flat state.

FIG. 1 is a front view of the handwarmer/fanny pack/article carrier of the present invention. This figure shows the body garment in its flat (i.e. non circular) state. For purposes of orientation of the various drawing figures, the central axis of the body garment is identified by the reference numeral 10. The main portion of the article comprises an elongated tubular cloth member 11 that is formed of a heat insulating material, preferably a fleece. As shown, member 11 is of a relatively long axial length, preferably about 12 inches long in an adult's size and about 9 inches long in a child's size, and is of a generally uniform diameter, preferably about 6 inches in diameter in an adult's size and about 4.5 inches in diameter in a child's size. Member 11 is open at the two opposite axial ends 12 and 13 thereof. Member 11 includes a top external surface 14 and a front external surface 15 (see FIG. 2). The back external surface 21 of the article is of a generally plain construction.

Figure 2:
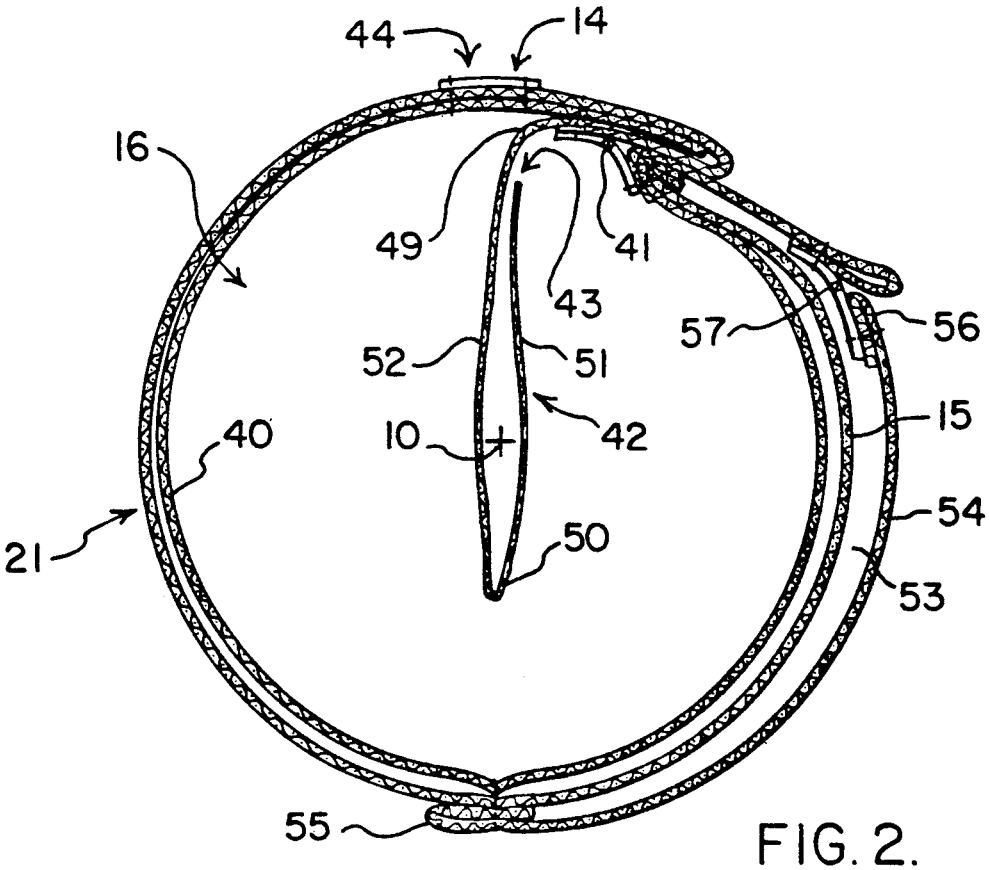
FIG. 2 is a section view of the invention, taken in the position shown as 2—2 in FIG. 1, and with the body garment in its circular or expanded state.

FIG. 2 is a section view of the invention, taken in the general position shown as 2—2 in FIG. 1, but with the body garment in its circular or expanded state. FIG. 2 shows an internal handwarmer chamber 16 that is defined by tubular cloth member 11, FIG. 1, between the two open ends 12,13 thereof.

The two open ends 12,13 of member 11 each have a tubular cuff 17,18 stitched thereto, as by way of stitch areas or lines 26,27. As a feature of the invention, stitch area 26 includes the fastening of a short section of cloth web 28 to the article, web section 28 serving to mount a metal D-ring 29 at front surface 15 of the article, for the fastening of ski gloves and the like thereto.

The central axis of each of the cuffs 17,18 is located so as to be generally coincident with axis 10. Each cuff 17,18 is of a relatively short axial length, preferably about 3 inches long in both the adult and the child's size, and of a generally uniform diameter, preferably about 6 inches in diameter in the adult size and about 4.5 inches in size in the child's size. Cuffs 17,18 are formed of a stretchable heat insulating material, preferably a fleece, and define the two circular shaped open ends 19,20 of the article.

Figure 3:
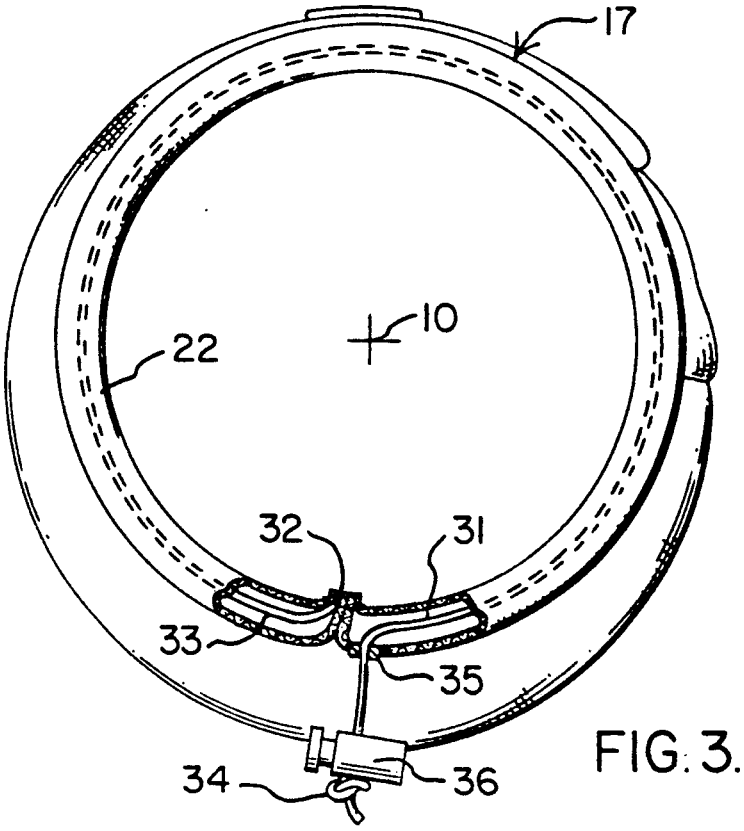
FIG. 3 is an end view of one of the cuffs of FIG. 1, showing the manner in which the cuff's elastic cord and barrel shaped locking device are associated therewith.

Each of the cuffs 17,18 is stitched at 24,25 so as to provide tubular seams or cord guide chambers 22,23 at the respective open ends 19,20 of the article. FIG. 3 is a view of cuff 17 as seen from open end 19. In FIG. 3 a portion of cord guide chamber 22 has been cut away. For purposes of simplicity, various structural features of the article that are apparent from such an end view have been eliminated from FIG. 3.

As seen in FIGS. 1 and 3, an elongated, elastic cord 30,31 is provided in each of the cuff seams 22,23. FIG. 3 shows that a first end 33 of each cord is attached to its cuff, as by stitching, at an attachment point shown at 32. The second end 34 of each cord is threaded through a metal eyelet 35, adjacent to attachment point 32, thus allowing the cord to extend external of the cuff. In an exemplary embodiment of the invention cords, 30,31 were about 14 inches long and about 3 mm in diameter.

The extending second end 34 of each cord 30,31 mounts a slideable cord lock member 36,37. Preferably lock members 36,37 comprise well known plastic barrel shaped locking devices, each locking device having a spring loaded and manually depressible plunger 38,39, of well known construction.

As will be apparent to those of skill in the art, manual movement of lock members 36,37 along cords 30,31 operates to control the effective size of end openings 19,20, i.e. end openings 19,20 are adjustable between fully open and fully closed conditions. In this way, the size of end openings 19,20 may be compliantly regulated to an individual's wrist or hand size, or end openings 19,20 may be completely closed when handwarmer chamber 16 is used to carry small articles, for example in the manner of a fanny pack, or an elongated article(s), such as a pair of skis, may be threaded through end openings 19,20 so that the bindings or balancing point thereof are located generally within handwarmer chamber 16, and cords locks 36,37 may then be adjusted to entrap the balancing portion of the article(s) for carrying, for example by shoulder support.

In an exemplary embodiment of the invention, lock members 36,37 comprised Fastex brand (by ITW Nexus) barrel shaped locking devices.

As best seen in FIG. 2, a feature of the invention is that handwarmer chamber 16 is lined with a moisture wicking cloth material 40. A first elongated zipper 41 of conventional construction is located generally at the top surface 14 of tubular cloth member 11. Zipper 41 extends generally parallel to central axis 10. Zipper 41 includes a manual pull tab 70 (see FIG. 1), and when zipper 41 is open it provides manual access to handwarmer chamber 16.

Also as is best seen in FIG. 2, an open-mesh cloth bag 42 is provided within handwarmer chamber 16. Bag 42 is adapted to removably hold a heat source (not shown) within chamber 16. The detailed construction of bag 42 is not critical to the invention. For example, bag 42 may contain two compartments that are spaced in the direction of central axis 10. In a preferred embodiment of the invention, open-mesh cloth bag/pocket 42 was formed from two cloth panels 51 and 52 each having a top edge, a bottom edge 50 and side edges 58,59 (see FIG. 1), the side and bottom edges being joined to form open top bag 42, and the top edge 49 of one of the cloth panels being joined to the top wall of handwarmer chamber 16 adjacent to first zipper 41, i.e. bag 42 comprised two cloth panel that were stitched on three edges thereof, so as to provide an open top 43 adjacent to zipper 41, thus positioning open top 43 for manual access when zipper 41 is open.

Alternate utility of the body garment of this invention as a handwarmer, as a fanny pack, and as a carrier of elongated articles such as skis is facilitated by an adjustable length belt 44 that is attached to the top surface 14 of tubular cloth member 11 at least at spaced attachment points 45 and 46. Belt 44 includes a manually releasable coupling means 47 within the adjustable length 48 thereof. Coupling means 47 enables adjustment of belt length for alternate encirclement of the waist of a user, for positioning of the body garment to the front or to the rear of the user, or for shoulder support of the body garment by the user. When the body garment is positioned to the front of the user, it can be used as a handwarmer, with or without the provision of a heat source within bag 42. When a heat source is provided, bag 42 is grasped and thus completely covered by the user's hands, the holes in the open-mesh bag operating to maximize heat transfer between the heat source and the hands. When bag 42 comprises two heat source compartments, a separate heat source is provided for each hand.

For example, coupling means 47 preferably comprises a plastic Fastex brand (by ITW Nexus) side release buckle. In an exemplary embodiment of the invention, belt 44 comprised a Nylon web material about 1 inch wide, having a maximum extended length of about 48 inches.

While the fabric material from which the body garment of the invention is made is not to be taken as a limitation on the invention, it is preferred that tubular cloth member 11 be formed of a synthetic fleece material, that moisture wicking lining 40 be formed of a synthetic moisture wicking material, that open-mesh cloth bag/pocket 42 be formed of a synthetic material, that elongated tubular cuffs 17,18 be formed of a synthetic, stretchable fleece material, and that belt 44 be formed of a synthetic material such as the brand Nylon.

By way of example, the synthetic fleece portions of the body garment may be formed of the brand Polarplus (by Malden Mills, Inc.), double-faced fabric, having a plush finish on both sides thereof. This material absorbs very little water, thus providing for fast drying. This material provides warmth even when wet. Also by way of example, the synthetic moisture wicking portions of the body garment may be formed of the brand Polartek (by Malden Mills, Inc.) single faced velour material. Polartek is a hollow core polyester material having good moisture wicking and heat insulating properties.

A feature of the present invention provides a security chamber or pocket that is spaced from the front surface 15 of the article.

Security pocket 53 is best seen in FIG. 2. As can be seen, pocket 53 is formed by providing a generally rectangular cloth member 54 having a bottom edge 55, oppositely disposed side edges that are coincident with stitch lines 26,27, and a top edge 56. Bottom edge 55 and the side edges of cloth member 54 are stitched or joined to front surface 15 of tubular member 11, to form an open top security chamber 53 between cloth member 54 and front surface 15.

A second elongated zipper 57 is stitched to the top edge of cloth member 54 and to front surface 15, so as to closeably join top edge 56 to front surface 15. Zipper 57 extends generally parallel to central axis 10. Zipper 57 includes a manual pull tab 71 (see FIG. 2), and when zipper 57 is open it provides access to security chamber 53.

It is preferred that cloth member 54 be formed of the above mentioned synthetic, stretchable, fleece material.

As will be appreciated by those skilled in the art, the body garment of the invention may be formed so as to provide a placket to cover each of the zippers 41 and 57. Since the manner in which the above described cloth article is machine stitched to form the various described structural elements is well known in the art, it will not be described herein in detail.

The term zipper, as used herein is intended to be taken in its broadest sense. For example, zippers 41 and 57 can to good advantage be provided as the well known double sided or reversible type zippers having two pull tabs, with one pull tab on each side of the zipper. Thus, in the case of zipper 41 in particular, handwarmer chamber 16 can be opened by manual operation of zipper 41 from both the exterior and the interior of chamber 16.

While the invention has been described in detail with reference to preferred embodiments thereof, it is apparent that those skilled in the art, upon learning of the invention, will visualize yet other embodiments that are within the spirit and scope of the invention, Thus it is intended that the spirit and scope of the invention be limited only by the following claims.

What is claimed is:

1. A body garment having utility as a handwarmer, as a fanny pack and as a carrier of elongated articles such as skis and the like, comprising;

an elongated, heat insulating, tubular cloth member, said tubular member having a central axis, said tubular member being of relatively long axial length and of generally uniform diameter along the axial length thereof, said tubular member having two oppositely disposed and generally circular open ends, and said tubular member having an internal handwarmer chamber located intermediate said two open ends, a top external surface, and a front external surface, a moisture wicking cloth lining said handwarmer chamber, a first elongated zipper located generally on the top surface of said tubular member and extending generally parallel to said central axis, said first zipper, when open, providing access to said handwarmer chamber, an open-mesh cloth bag/pocket adapted to hold a heat source within said handwarmer chamber, said mesh bag having an open top, and said mesh bag being fastened within said handwarmer chamber so as to position the open top of said mesh bag for access when said first zipper is open, a pair of elongated tubular cuffs of heat insulating cloth, said cuffs being joined to said tubular member with one cuff attached to each of said two open ends of said tubular member, said cuffs each having a central axis located substantially coincident with the central axis of said tubular member, said cuffs being of relatively short axial length and of generally uniform diameter along the axial length thereof, and said cuffs defining two oppositely disposed generally circular open ends, wherein said tubular member and said pair of cuffs being of sufficient size to receive a portion of a pair of skis, a pair of cord-guide chambers, one of said cord-guide chambers encircling the central axes of one of said cuffs at the open end thereof, a pair of flexible, elongated, cords located with one cord within each of said cord-guide chambers, each of said cords having a first and a second end, said first end of each cord being attached to one of said cuffs and extending through a cord-guide chamber thereof such that a portion of said cord extends outside of the cuff as the second end of the cord exits a cord-guide chamber adjacent to attachment of said first cord end to a cuff, a pair of lock members, each of which is slideably located on an extending portion of one of said cords, movement of said lock members along said extending cord portion serving to control the physical size of the generally circular open ends of said cuffs, an adjustable length belt having first and second spaced attachment portions, the first attachment portion of said belt being attached to said top surface of said tubular member adjacent one open end thereof and the second attachment portion of said belt being attached to said top surface of said tubular member adjacent the other open end thereof, and manually operable coupling means within the adjustable length of said belt enabling said belt for alternate encirclement of the waist of an individual, for positioning of said body garment to the front or to the rear of the individual, or for shoulder support of said body garment by the individual.

2. The body garment of claim 1 including ring attachment means mounted on the front surface of said tubular member.

3. The body garment of claim 2 including a security chamber comprising;

generally rectangular cloth member having a bottom edge, oppositely disposed side edges, and a top edge, said bottom edge and said side edges being joined to the front surface of said tubular member to form said security chamber between said rectangular cloth member and the front surface of said tubular member, and a second zipper located to closeably join said top edge of said rectangular cloth member to the front surface of said tubular member and extending generally parallel to the central axis of said tubular member, said second zipper, when open, providing access to said security chamber.

4. The body garment of claim 1 wherein said open-mesh cloth bag/pocket is formed from two cloth panels each having a top edge, a bottom edge and side edges, said side and bottom edges being joined to form an open top bag, and the top edge of one of said cloth panels being joined to said handwarmer chamber adjacent to said first zipper, and wherein the diameter of said cuffs is generally equal to the diameter of said tubular cloth member.

5. The body garment of claim 4 wherein said tubular cloth member is formed of a synthetic double sided fleece material, wherein said moisture wicking lining is formed of a hollow core polyester moisture wicking material, wherein said open-mesh cloth bag/pocket is formed of a synthetic material, wherein said pair of elongated tubular cuffs are formed of a synthetic double sided fleece material, wherein said belt is formed of a synthetic material, and wherein said cords are elastic cords.

6. The body garment of claim 5 including an article-holding security chamber comprising;

a synthetic fleece member having a bottom edge, oppositely disposed side edges, and a top edge, said bottom edge and said side edges being joined to the front surface of said tubular member to form said security chamber adjacent to the front surface of said tubular member, and a second zipper located to closeably join said top edge of said synthetic fleece member to the front surface of said tubular member and extending generally parallel to the central axis of said tubular member, said second zipper, when open, providing access to said security chamber.

7. The body garment of claim 6 including ring attachment means attached to said body garment.

8. A body garment, comprising;

an elongated tubular cloth member, said tubular member having a central axis, said tubular member having two oppositely disposed and generally circular open ends, and said tubular member having an internal chamber located intermediate said two open ends, a top external surface, and a front external surface, a first elongated zipper located generally on the top surface of said tubular member and extending generally parallel to said central axis, said first zipper, when open, providing access to said internal chamber, a cloth bag adapted to hold a heat source within said internal chamber, said bag having an open top, and said bag being fastened within said internal chamber so as to position the open top of said bag for access when said first zipper is open, a pair of elongated tubular cloth cuffs, said cuffs being joined to said tubular member with one cuff attached to each of said two open ends of said tubular member, said cuffs each having a central axis located substantially coincident with the central axis of said tubular member, and said cuffs defining two oppositely disposed generally circular open ends, a pair of cord-guide chambers, one of said cord-guide chambers encircling the central axes of one of said cuffs at the open end thereof, a pair of flexible, elongated, cords located with one cord within each of said cord-guide chambers, each of said cords having a first and a second end, said first end of each cord being attached to one of said cuffs and extending through a cord-guide chamber thereof such that a portion of said cord extends outside of the cuff as the second end of the cord exits a cord-guide chamber adjacent to attachment of said first cord end to a cuff, a pair of lock members, each of which is slideably located on an extending portion of one of said cords, movement of said lock members along said extending cord portion serving to control the physical size of the generally circular open ends of said cuffs, an adjustable length belt having first and second spaced attachment portions, the first attachment portion of said belt being attached to said top surface of said tubular member adjacent one open end thereof and the second attachment portion of said belt being attached to said top surface of said tubular member adjacent the other open end thereof, and manually operable coupling means within the adjustable length of said belt.

9. The body garment of claim 8 including a moisture wicking cloth lining said internal chamber.

10. The body garment of claim 9 wherein said tubular member is of an axial length in the range of from about 12 inches to about 9 inches and is of a diameter in the range of from about 6 inches to about 4.5 inches, and wherein said cuffs are of an axial length of about 3 inches and are of a diameter in the range of from about 6 inches to about 4.5 inches.

11. The body garment of claim 10 wherein said tubular member is formed of a synthetic double sided fleece material, wherein said moisture wicking lining is formed of a hollow core polyester moisture wicking material, wherein said bag is formed of a synthetic material, wherein said cuffs are formed of a synthetic double sided fleece material, wherein said belt is formed of a synthetic material, and wherein said cords are elastic cords.

12. The body garment of claim 11 including a second chamber, comprising;

a cloth member having a bottom edge, oppositely disposed side edges, and a top edge, said bottom edge and said side edges being joined to the front surface of said tubular member to form said second chamber adjacent to the front surface of said tubular member, and a second zipper located to closeably join said top edge of said cloth member to the front surface of said tubular member and extending generally parallel to the central axis of said tubular member, said second zipper, when open, providing access to said second chamber.

* * * * *